US006532717B1

(12) United States Patent
Forgnone et al.

(10) Patent No.: US 6,532,717 B1
(45) Date of Patent: Mar. 18, 2003

(54) METHOD AND APPARATUS FOR SEALING A FLEXIBLE BAG TO A PALLET

(75) Inventors: Frederick Forgnone, Salinas, CA (US); Marvin Weeks, Jr., Port Hueneme, CA (US); Richard F. J. MacLeod, Salinas, CA (US)

(73) Assignee: Fresh Express, Inc., Salinas, CA (US)

( * ) Notice: Subject to any disclaimer, the term of this patent is extended or adjusted under 35 U.S.C. 154(b) by 0 days.

(21) Appl. No.: 09/573,430

(22) Filed: May 16, 2000

(51) Int. Cl.[7] ..... B65B 13/02

(52) U.S. Cl. ..... 53/399; 53/136.3; 53/136.4; 53/136.5; 53/211; 53/587

(58) Field of Search ..... 53/136.1, 136.3, 53/136.4, 136.5, 587, 211, 399

(56) References Cited

U.S. PATENT DOCUMENTS 3,466,843 A * 9/1969 Mumper ..... 53/136.4
4,821,489 A * 4/1989 MacLeod et al. ..... 53/399
5,020,300 A * 6/1991 Casteel ..... 53/399
5,327,706 A * 7/1994 Skole ..... 53/211

* cited by examiner

*Primary Examiner*—Rinaldi I. Rada
*Assistant Examiner*—Thanh Truong
(74) *Attorney, Agent, or Firm*—Patrick F. Bright; Bright & Lorig

(57) ABSTRACT

Apparatus and methods for gas-tight sealing a plastic bag about perishable containers carried on a pallet utilize a rotatable turntable having an upper support surface for a pallet bearing produce, a tape dispenser for applying tape to seal a plastic bag to plastic sheeting at the periphery of the pallet, and a roller system that includes four rotatable rollers rotatably mounted on a single carrier. The carrier applies pressure through two of the rollers simultaneously against the tape during rotation of the turntable to seal the tape to the plastic sheeting and bag.

10 Claims, 2 Drawing Sheets

METHOD AND APPARATUS FOR SEALING A FLEXIBLE BAG TO A PALLET

This invention relates to methods and apparatus for sealing a flexible bag, preferably a five-sided plastic bag, to a pallet having plastic sheeting at its periphery. Such pallets are used to hold and to convey containers of fresh produce such as strawberries from one location to another.

The methods and apparatus of this invention are improvements over the methods and apparatus disclosed in the following, issued U.S. Pat. Nos. 5,046,302; 5,014,495; and 4,821,489. The disclosures including the drawings of these patents are incorporated herein by reference as though fully set forth here.

These three issued U.S. patents describe systems that include a rotatable turntable and a single pressure roller to apply tape to bagged pallets of fresh produce to seal a five-sided plastic bag over a square pallet with plastic sheeting at its periphery and produce such as strawberries atop the pallet. These systems are less effective in sealing such a plastic bag to a rectangular or oblong pallet.

This invention provides a new system comprising a rotatable turntable, preferably, but not necessarily including, a plurality of pressure rollers to apply tape and to seal a five-sided, open-ended plastic bag to a pallet bearing produce and having plastic sheeting at its periphery, at a minimum, or over the pallet's upper surface and at its periphery. The rotatable turntable has an upper support surface to carry and support such a pallet. The pallet itself may be square, rectangular, oblong, or have a plurality of sides of equal or unequal length.

The system also includes an adhesive tape dispenser disposed in operative relationship to the rotatable turntable. The dispenser applies tape from a single roll of tape or a plurality (e.g. two) of rolls to seal a five-sided plastic bag to plastic sheeting at the periphery of the pallet, thus sealing the plastic bag to the plastic sheeting and to the pallet.

The system may include a pressure roller system comprising four rotatable rollers rotatably mounted on a single rotatable carrier. This carrier is operatively adapted to apply pressure against, and to seal the tape, substantially continuously, to the sheeting at the periphery of the pallet and to the edges at the open-end of the plastic bag that overlap the sheeting.

The pressure roller system is mounted for movement of the first and the second of the four rollers into engagement with the tape, the sheeting at the periphery of the pallet, and the plastic bag, during rotation of the turntable, and for rotation of the carrier during rotation of the turntable to bring one or more of the other rollers, i.e. the third of fourth rollers, into engagement with the edges of the pallet, sheeting, tape and bag during rotation of the turntable and to move the first roller, the second roller, or both, out of such engagement. For example, when a first roller meets an obstruction, and stalls, the roller assembly pivots around the stalled roller. Once the next roller in sequence contacts the surface to be sealed, pressure applied by the new roller, now the lead roller at the surface to be sealed, allows the following roller to overcome the obstruction and to continue on, applying pressure, but now as the following roller. This reference is as follows in summary:

A) A lead roller hits an obstruction and stalls;

B) The roller assembly flips or pivots on stalled lead roller;

C) Once roller assembly has flipped or rotated 90°, a new lead roller is established; and D) The former lead roller is now a following roller.

In preferred embodiments, the four rotatable rollers are mounted at the corners of a square array, and are carried on an adjustable, fluid e.g. air pressure-driven arm that moves the roller system into engagement with the adhesive tape, the edges of the sheeting and the plastic bag where the open edges of the plastic bag overlap the sheeting attached to the pallet. Thus, two of these four rotatable rollers apply pressure against, and seal such tape, substantially continuously, to the sheeting at the periphery of the pallet, and to the edges of the open end of a plastic bag that overlaps the sheeting, even when the rollers pass around the corners of a pallet.

In practice, for example, the first roller and the second roller may first engage the tape, the sheeting at the periphery of the pallet and the plastic bag, during rotation of the turntable. If the leading edge of the first roller, for example, encounters an obstruction or imperfection, formed for example by produce packages on such a pallet, the rotatable carrier turns, momentarily disengaging the second roller, and then turns, or flips, so that the first and fourth rollers, or the fourth and third rollers, engage the tape, the sheeting at the periphery of the pallet and the plastic bag, thereby renewing continuous application and pressure against them. Such flipping or turning or pivoting around the lead roller may occur at any time such an obstruction is encountered.

The methods of the invention comprise sealing an open-ended, five-sided plastic bag to plastic sheeting attached at the periphery of a pallet to provide a gas-tight container for respiring perishables placed on the pallet. The method includes the steps of placing plastic sheeting on the pallet, or at the periphery of the pallet, preferably with the sheeting edges extending over the periphery of the pallet; positioning an open plastic bag above the pallet, and over produce resting on the pallet, with the bag's open end margins lying adjacent (i.e. over or under) the plastic sheeting edges; applying adhesive tape simultaneously to the area where the plastic sheeting, and the ends of the plastic bag lie adjacent one another; and rotating the pallet, plastic bag and sheeting to apply such tape, substantially continuously, to seal the bag to the sheeting and thus to the pallet, by maintaining substantially continuous pressure contact of two rollers to the tape during tape application to the plastic bag and plastic sheeting.

In preferred embodiments, the methods of the invention comprise selecting a multi-sided e.g. a rectangular or oblong pallet whose length is at least ten percent greater than its width; placing perishables on the pallet; placing a plastic bag over the perishables such that the open edges of the plastic bag lie over or under plastic sheeting at or over the periphery of the pallet; placing the pallet assembly onto a rotatable turntable; and rotating the turntable while applying the tape to seal the plastic bag to the plastic sheeting, by maintaining contact of two or more pressure rollers to the tape during application of the tape to the bag and sheeting.

BRIEF DESCRIPTION OF THE DRAWINGS

The invention can better be understood by reference to the drawings, in which.

DETAILED DESCRIPTION OF THE DRAWINGS

Figure 1:
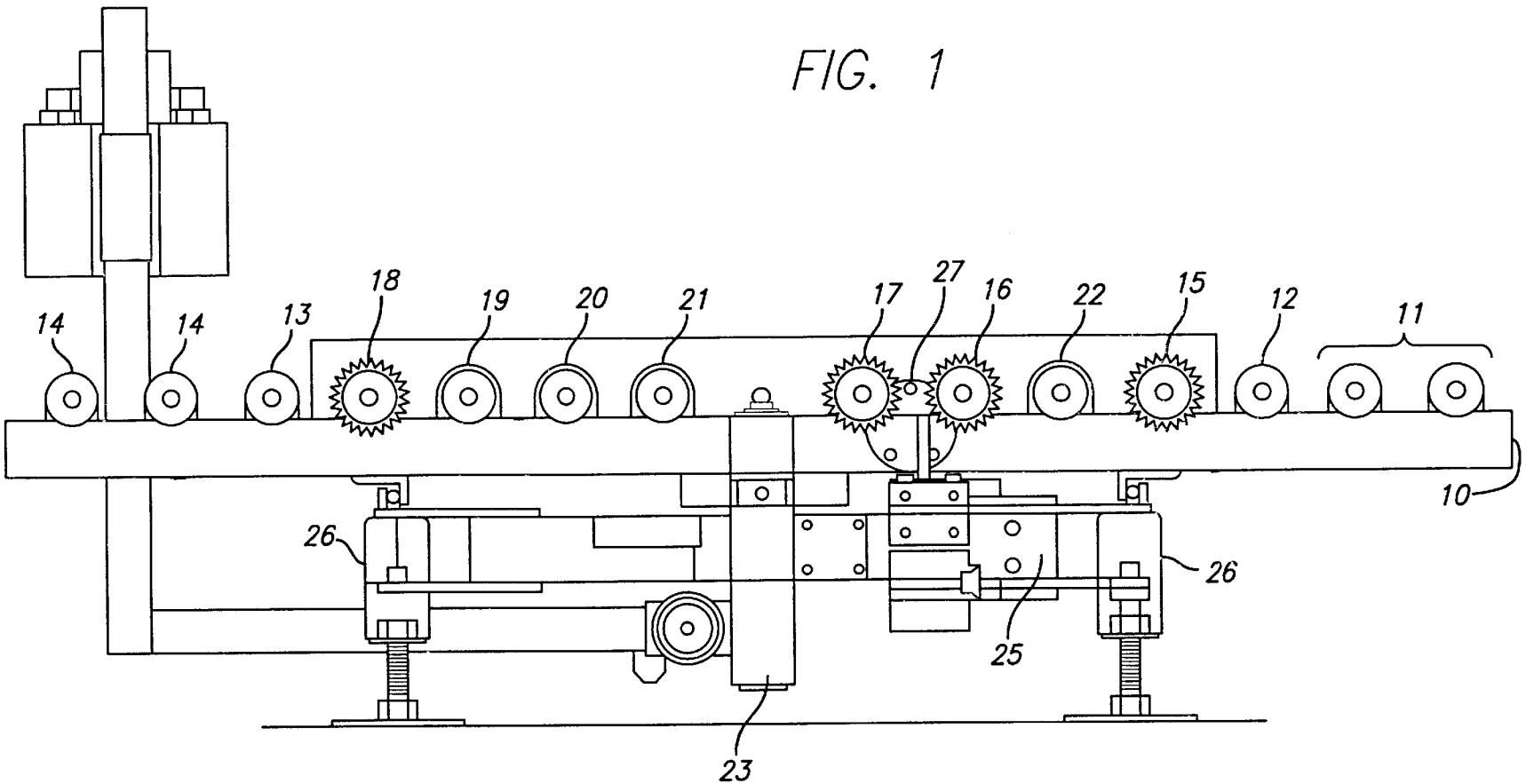
FIG. 1 is a side elevation view of a preferred embodiment of the system of this invention.
Figure 2:
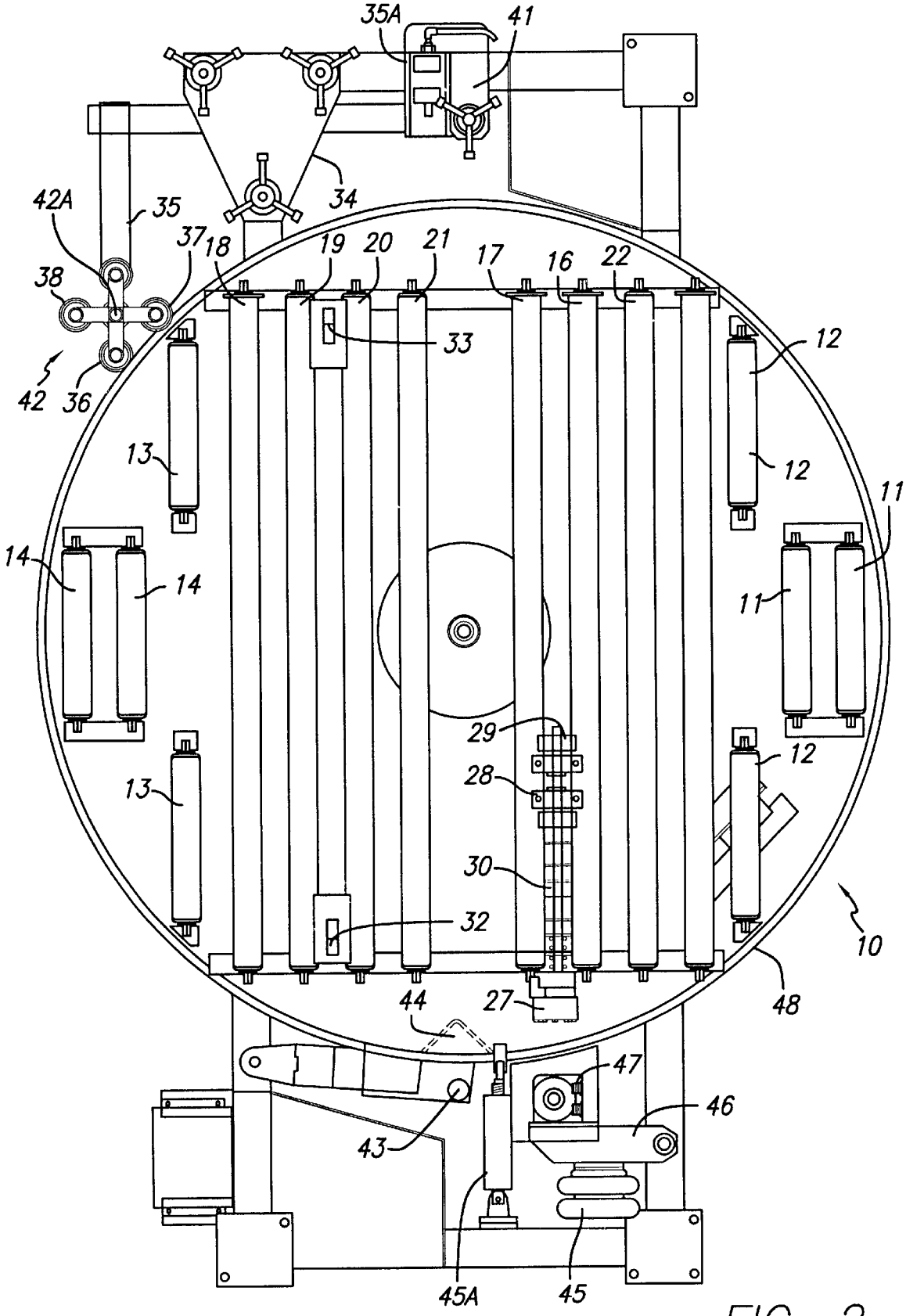
FIG. 2 is a top plan view of the system shown in FIG. 1.

FIGS. 1 and 2 show rotatable turntable 10 that includes, on the input end, two input idler rollers 11, and two input idler rollers 12, and, on the output end, two output idler rollers 13 and two output idler rollers 14. Near the center of turntable 10 are four sprocketed drive rollers 15, 16, 17, and 18, and four unsprocketed idler rollers 19, 20, 21 and 22. Turntable 10 rotates on rotatable axis 23 in response to forces from driver arm 25, which turn s ring 26 clockwise or counter-clockwise, here counterclockwise. Hydraulic motor 27, operating through clutch mechanism 30, drives axle 31 carrying drive rollers 28 and 29. Drive rollers 28 and 29 drive (i.e. rotate) sprocketed rollers 16 and 17. Sprocketed roller 16 is connected by a chain mechanism to, and drives roller 15. Roller 17 is connected by a chain mechanism to, and drives roller 18.

A pallet entering turntable 10 from the right, as seen in FIGS. 1 and 2, is pushed forward over idler rollers 11 and 12 to driven roller 15. From there, the pallet advances until the pallet passes over sensors 32 and 33. Sensors 32 and 33 actuate a timer which continues the driving of rollers 16, 17, 15, and 18 for a prescribed period of time, then discontinues the driving, and actuates a mechanism 43 which centers the pallet on turntable 10.

This system moves pallets smoothly and efficiently across turntable 10. The drive mechanism is compact, occupying minimal space atop turntable 10. The rollers and drive mechanism do not interfere with the taping operation, and their size and location minimize the distance that the tape applier and pressure rollers travel during pallet engagement and disengagement.

After a pallet is centered on turntable 10, sensors 32 and 33 generate signals that stop hydraulic motor 27 and disengage drive rollers 16 and 17. Before rotation of turntable 10 begins, an operator applies the end of tape from tape dispenser 34 to a corner of the pallet where the end of a plastic bag, placed open-end downward over a load of produce, lies adjacent to plastic sheeting at the pallet's periphery. An operator then pushes a button which initiates the desired rotation sequence. First, air actuator 45A moves pin 43 out of V-shaped notch 44. Next, air pressure bag 35A causes arm 35 to move pressure roller assembly 42 and rollers 36 and 37 into contact with the outside surface of the tape. Then, air bag 45 moves arm 46 and drive roller 47 into engagement with ring 26. Ring 26 rotates table 10 through 360°. Rollers 36 and 37 press and seal the tape to the area where the plastic sheeting and the open-end of the plastic bag overlap.

Arm 35, which is attached to pivot point 41, delivers a constant pressure near pivot point 41, creating a fulcrum effect between pivot point 41 and roller assembly 42. Preferably, the pressure in the inflated air bag is about 80 psi, which in turn yields a 300 psi force near pivot point 41. This force is nearly constant over the travel distance of arm 35 at pivot point 41, as is the force delivered at roller assembly 42. Preferably, during rotation, this force is about fifty pounds. As a result, roller assembly 42 applies a constant force against the tape, the plastic sheeting at the periphery of the pallet and the adjacent margin of the plastic bag.

As table 10 rotates through 360°, rollers 37 and 36 contact and apply pressure to the tape, sheeting, and bag. If lead roller 37 encounters an obstruction, lead roller 37 may stall or momentarily stop. When lead roller 37 stops, roller assembly 42 pivots 90° around roller 37. Roller assembly 42 freely rotates around center bearing 42A. Once assembly 42 pivots 90°, pressure roller 39 engages the plastic sheeting, tape, and bag and becomes the new lead roller, with roller 37 being the following roller. If a subsequent obstruction is encountered during the 360° rotation of table 10, roller assembly 42 pivots on new lead roller 39, rotating roller 38 into the lead roller position, and so on.

After turntable 11 has rotated 360° with roller assembly 42 sealing the tape over the area of bag/sheeting overlaps, and with roller assembly 42 itself pivoting to move one or more rollers e.g. rollers 36 and 37 out of contact, and one or more other rollers into contact with the applied tape, air pressure is released from actuator 35A, and roller assembly 42 disengages from the tape. Next, air is released from actuator 45, drive roller 47 disengages from ring 26 and then air actuator 45A moves pin 43 into the notch in V-shaped member 44. An operator then cuts the tape, and restarts drive rollers 16 and 17 to move the pallet off turntable 10.

What is claimed is:

1. Apparatus for gas tight sealing a plastic bag about perishable containers carried on a four-sided pallet, said pallet having at least two sides of differing length, said pallet having plastic sheeting at the edges of the pallet, said bag having open edges at one end of said bag lying adjacent said sheeting, comprising:

a rotatable turntable having an upper support surface on which said pallet rests;

a tape dispenser disposed in operative relationship to said rotatable turntable to apply tape from said dispenser to seal said plastic bag to said plastic sheeting; and a roller system including four rotatable rollers rotatably mounted on a single, rotatable carrier, said carrier alone being operatively adapted to apply pressure to said adjacent edges and said sheeting with two of said rollers substantially continuously against said tape during substantially continuous rotation of said turntable, whereby said tape seals said sheeting to said bag on all four sides of said four-sided pallet, said carrier being operatively adapted to move one or more of said rotatable rollers into or out of engagement with said edges and said sheeting whenever encountering an obstruction or imperfection.

2. The apparatus of claim 1 wherein said roller system is mounted for movement of any two of said four rollers into engagement with the edges of said pallet during rotation of said turntable, and for rotation of said carrier during rotation of said turntable to bring one or more other rollers into said engagement, and one or more of said two rollers out of said engagement.

3. The apparatus of claim 1 wherein said four rotatable rollers are mounted at the corners of a square array, and are rotatable around a common pivot point.

4. The apparatus of claim 1 wherein said carrier is rotatably mounted on an adjustable, fluid pressure-driven arm.

5. The apparatus of claim 1 wherein said roller system includes an adjustable, air pressure-driven actuator that delivers a desired, substantially constant pressure through two of said rollers simultaneously to said tape during application of said tape to seal said plastic bag to said pallet.

6. Apparatus for gas tight sealing a plastic bag about perishable containers carried on a four-sided pallet, said pallet having at least two sides of differing length, plastic sheeting at the edges of the pallet, said bag having open edges at one end of said bag lying adjacent said sheeting, comprising:

a rotatable turntable having an upper support surface on which said pallet rests;

a tape dispenser disposed in operative relationship to said rotatable turntable to apply tape from said dispenser to seal said plastic bag to said plastic sheeting; and a roller system including four rotatable rollers rotatably mounted on a single, rotatable carrier, said carrier alone being operatively adapted to apply pressure to said adjacent edges and said sheeting with two of said rollers substantially continuously against said tape during substantially continues rotation of said turntable, whereby said tape seals said sheeting to said bag on all four sides of said four-sided pallet.

7. The apparatus of claim 6 wherein said roller system is mounted for movement of any two of said four rollers into engagement with the edges of said pallet during rotation of said turntable, and for rotation of said carrier during rotation of said turntable to bring one or more other rollers into said engagement, and one or more of said two rollers out of said engagement.

8. The apparatus of claim 6 wherein said four rotatable rollers are mounted at the corners of a square array, and are rotatable around a common pivot point.

9. The apparatus of claim 6 wherein said carrier is rotatably mounted on an adjustable, fluid pressure-driven arm.

10. The apparatus of claim 6 wherein said roller system includes an adjustable, air pressure-driven actuator that delivers a desired, substantially constant pressure through two of said rollers simultaneously to said tape during application of said tape to seal said plastic bag to said pallet.

* * * * *